United States Patent [19]

Smith

[11] 4,159,456

[45] Jun. 26, 1979

[54] MAGNETIZING APPARATUS AND METHOD FOR USE IN CORRECTING COLOR PURITY IN A CATHODE RAY TUBE AND PRODUCT THEREOF

[75] Inventor: Joseph L. Smith, Indianapolis, Ind.

[73] Assignee: RCA Corporation, New York, N.Y.

[21] Appl. No.: 819,094

[22] Filed: Jul. 26, 1977

[51] Int. Cl.[2] ..... H01F 7/00

[52] U.S. Cl. ..... 335/210; 335/284

[58] Field of Search ..... 335/210, 213, 284, 212

[56] References Cited

U.S. PATENT DOCUMENTS 4,105,983 8/1978 Barten ..... 335/212

*Primary Examiner*—George Harris

*Attorney, Agent, or Firm*—Eugene M. Whitacre; Paul J. Rasmussen; Joseph Laks

[57] ABSTRACT

A cathode ray tube of a color television receiver includes a magnetic material located adjacent to a neck portion. A magnetizing apparatus is used for establishing the color purity of three in-line electron beams within the cathode ray tube. The magnetizing apparatus comprises at least two elongated conductor loops arranged for positioning about the neck in proximity to the magnetic material and capable of being energized by a magnetizing current for creating permanently magnetized regions within the material. The magnetized regions produce a color purity magnetic field within the cathode ray tube for establishing the color purity of the three in-line electron beams. An elongated portion of each of the conductor loops follows along a portion of the periphery of the neck.

15 Claims, 11 Drawing Figures

MAGNETIZING APPARATUS AND METHOD FOR USE IN CORRECTING COLOR PURITY IN A CATHODE RAY TUBE AND PRODUCT THEREOF

BACKGROUND OF THE INVENTION

This invention relates to color purity adjustment of cathode ray tubes for color television receivers.

Color display systems such as utilized in color television receivers include a cathode ray tube in which three electron beams are modulated by color-representative video signals. The beams impinge on respective color phosphor areas on the inside of the tube viewing screen through apertures in a shadow mask. To accurately reproduce a color screen, the three beams must be substantially converged at the screen at all points on the raster. The deflection center of each of the three beams must be correctly located in the yoke deflection plane to establish color purity. Incorrectly located deflection centers, due to such factors as incorrect placement of the deflection yoke, tolerances in the manufacture of the electron beam guns, and their assembly into the cathode ray tube neck, frequently result in color misregistration.

Many color purity devices include structure for producing adjustable magnetic fields. The devices are placed over the neck of the cathode ray tube, and the magnetic fields are appropriately adjusted to provide for color purity of the electron beams. Such adjustment is accomplished by moving magnetic field producing elements, by rotating magnetized rings about the cathode ray tube neck, or by rotating cylindrical magnets about an axis.

Other color purity devices, such as disclosed in German Provisional Pat. No. 2,611,633, filed Mar. 19, 1976, published Oct. 21, 1976, by Piet Gerard Joseph Barten et al., produce permanent nonadjustable magnetic fields. In a first step, an auxiliary device having eight coils circumferentially located is placed around the cathode ray tube neck. Appropriately valued DC currents flowing through the coils establish a magnetic field which provide for color purity of the electron beams. The values of the DC currents provide data to a magnetizing apparatus which in a second step magnetizes regions within a sheath or strip of magnetic material producing the aforementioned permanent nonadjustable magnetic fields. The magnetized strip, when placed over the neck of the cathode ray tube, establishes the color purity of the electron beams.

It is desirable, when using such a magnetic strip, to eliminate the step of utilizing an auxiliary device for determining the locations within the strip where magnetized regions are to be established. A magnetizing apparatus, not utilizing such an auxiliary device, should have magnetizing areas arranged to facilitate uncomplicated operation when directly performing color purity operations.

For an in-line cathode ray tube with three in-line electron beams and a slot shadow mask with vertical slot apertures, color purity correction requires only horizontal, like-direction motion of all three beams. The magnetic field produced by the permanently magnetized regions need only have a vertical component perpendicular to the in-line axis of the cathode ray tube to produce the horizontal motion.

As color purity correction may require large motions, the magnetic strip must be capable of producing a sufficiently strong color purity magnetic field. Furthermore, the correction introduced by the color purity magnetic field must not introduce any substantial misconvergence of the electron beams, that is, the motion of all three electron beams should be in substantially identical directions and of substantially identical magnitudes.

SUMMARY OF THE INVENTION

A magnetizing apparatus is used for establishing the color purity of three in-line electron beams within a cathode ray tube of a color television receiver, the cathode ray tube including a magnetic material located adjacent to a neck portion. The apparatus comprises at least two conductor loops arranged for positioning about the neck portion in proximity to the magnetic material. Each of the conductor loops is capable of being energized by a magnetizing current for creating permanently magnetized regions within the magnetic material to produce a color purity magnetic field within the cathode ray tube for establishing the color purity of the three in-line electron beams. An elongated portion of each of the conductor loops follows along a portion of the periphery of the neck portion.

DESCRIPTION OF THE INVENTION

Figure 1:
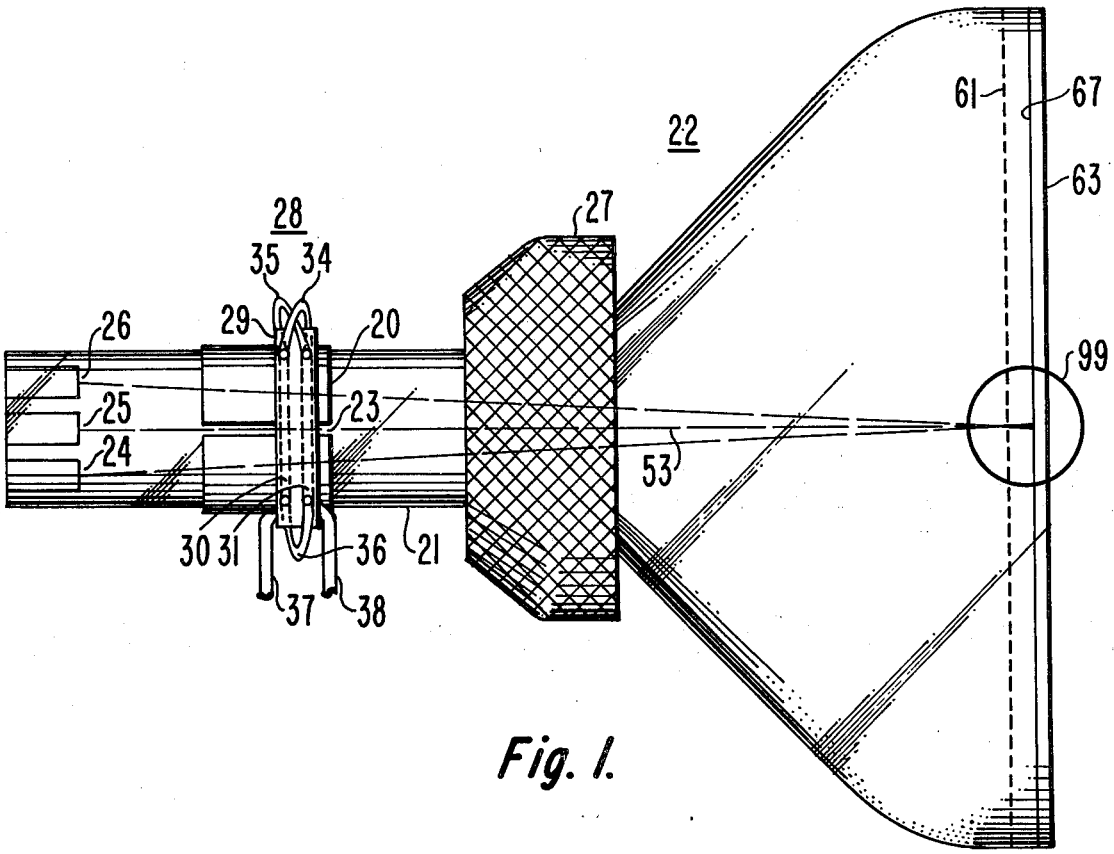
FIG. 1 is a top elevation view of a cathode ray tube, magnetic material, and magnetizing apparatus according to the invention.

In FIG. 1, a magnetic material comprising a magnetizable strip or sheath 20 is placed adjacent a neck portion 21 of cathode ray tube 22. Strip 20 is long enough to be wrapped around neck 21 providing only a small gap 23 at the top to avoid overlying of material. The composition of the magnetic material for strip 20 may be conventional barium ferrite mixed in a rubber or plastic binder material. Strip 20 may be held in a fixed relation to neck 21 by gluing or by wrapping around the strip a thin nonmagnetic tape.

Cathode ray tube 22 includes three in-line guns 24, 25 and 26 for producing blue, green and red electron beams, respectively. The green gun is illustratively along the central axis 53 of the tube. To obtain a raster, a deflection apparatus 27, which may comprise conventional horizontal and vertical windings, is placed around neck 21. Static or center convergence is achieved, as illustrated by the magnified cross-sectional view 99 of FIG. 2, when all three in-line beams intersect in the plane of a shadow mask 61 through an appropriate aperture 62 to impinge on a common phosphor trio of a phosphor screen 67 deposited on a faceplate 63 of cathode ray tube 22.

Figure 2:
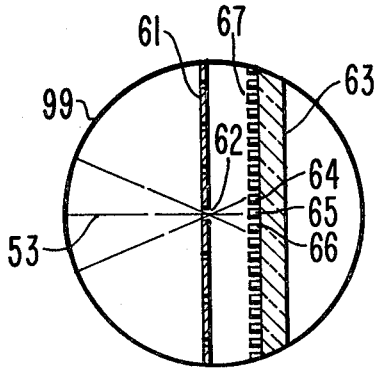
FIG. 2 is a magnified cross-sectional view of a portion of the cathode ray tube of FIG. 1 which illustrates the color purity of three in-line beams of the cathode ray tube.

To obtain color purity, permanently magnetized regions of appropriate polarity and pole strength are created in magnetic strip 20. These regions produce an interior color purity magnetic field for moving the three in-line beams onto their respective color phosphor stripes 64–66, as illustrated in FIG. 2.

Figure 3:
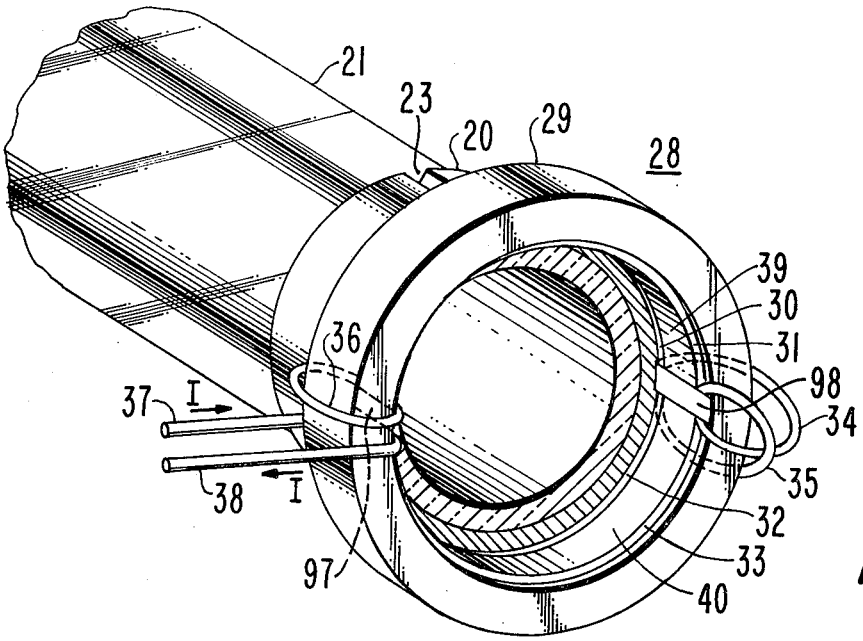
FIG. 3 is a perspective view of the magnetizing appartus of FIG. 1 with a portion of the cathode ray tube and magnetic material removed.

To create these regions, a magnetizing apparatus 28 is placed around magnetic strip 20. Magnetizing apparatus 28 comprises an annular housing 29 of nonmagnetic material within which inner surface are embedded four conductor wires 30–33 so shaped as to extend tangential to the circumference of neck 21, as illustrated in FIG. 3. Wires 30–33 may be either circular or square in cross-section. Spacers 97 & 98 separate wires 30 & 31 from wires 32 & 33. Connecting wires 34 and 35 couple together ends of wires 30 and 33 and 31 and 32, respectively. The other ends of wires 30 and 31 are coupled together by a connecting wire 36. The other ends of wires 32 and 33 are coupled to terminal wires 37 and 38, respectively. Terminal wires 37 and 38 may be coupled to a source of magnetizing current, not shown, of a selectable polarity, magnitude, and duration for creating appropriate permanently magnetized regions for establishing color purity.

Figure 4:
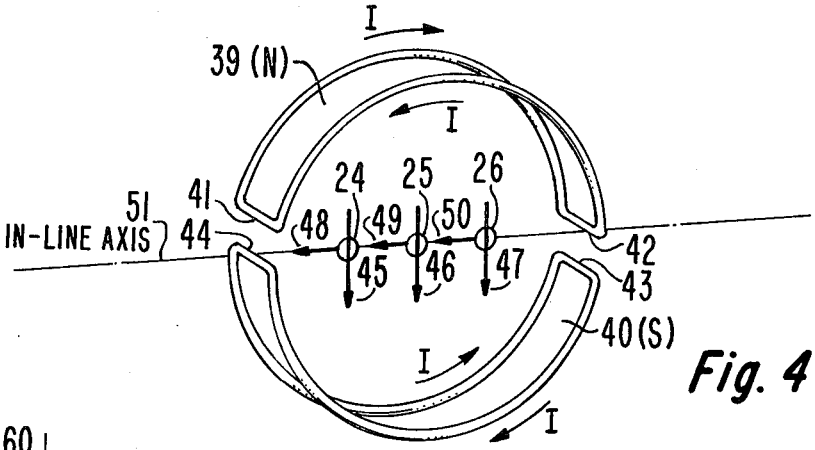
FIGS. 4 and 5 illustrate magnetic field lines and forces produced by the magnetizing apparatus of FIG. 3.

With the wire coupling as described, the four wires form two elongated conductor current loops 39 and 40. Each of the conductor loops is therefore shaped to extend tangentially along the periphery of neck 21. If the conductor loops are energized by a peak magnetizing current I flowing in the direction of the arrows of FIG. 3, the current flows in each of the conductor loops in the direction indicated by the arrows in FIG. 4, the connecting and terminal wires 34–38 being functionally represented by end turns 41–44.

The magnetizing current creates magnetized regions in the material of the magnetic strip which, in turn, will produce the vertical field lines 45–47 intersecting the beams 24–26 along the in-line axis 51. The field lines produce horizontal forces and motions 48–50 for establishing the color purity of the three in-line beams. The color purity misregistration is observed on the screen of cathode ray tube 22. Current pulses of appropriate peak magnitude and direction are coupled to terminal wires 37 and 38 producing the desired beam motions. If any misregistration still exists, the above procedure is repeated until the desired degree of color purity is achieved. A method of coupling magnetizing current pulses to magnetizing apparatus 28 that will stabilize the magnetic material within strip 20 and prevent demagnetization of the magnetized mass with the magnetized regions is disclosed in co-pending U.S. patent application entitled, MAGNETIZING METHOD FOR USE WITH A CATHODE RAY TUBE, Ser. No. 819,095, filed concurrently herewith, by Joseph Leland Smith.

Figure 5:
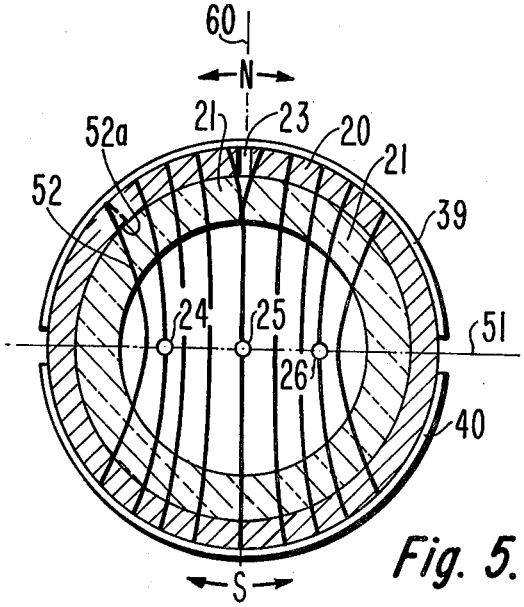

Barium ferrite used as the magnetic material for strip 20 has a relatively permeability near 1. Thus, as shown in FIG. 5, the magnetic field lines 52 pass through the material of strip 20 without substantial shaping or distortion. Field lines of sufficient intensity will impress a similar color purity permanent magnetic field into the material for establishing the color purity of the beams.

By shaping the elongated conductor loops 39 and 40 to extend lengthwise along a portion of the periphery of neck 21 so that the ends of the conductor loops are located adjacent the horizontal in-line axis 51, the interior magnetic field 52, in a plane perpendicular to the central axis, becomes a pincushion-shaped field, that is, a field that increases in intensity along the line of deflection of the central beam, as illustrated in FIG. 5. Such a field is desirable to offset the barrel shaped fields produced by magnetic strips 20 in planes perpendicular to central axis 53 but located at some distance from the strip. Such an arrangement provides for substantially identical magnitude motions of the three beams.

Figure 6:
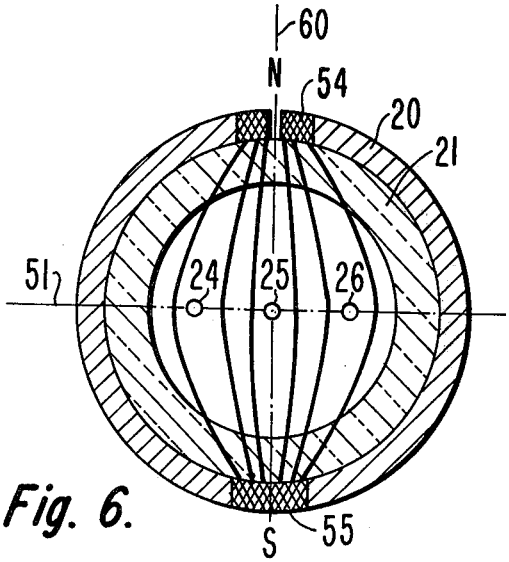
FIGS. 6–11 illustrate various magnetic field producing configurations.
Figure 7:
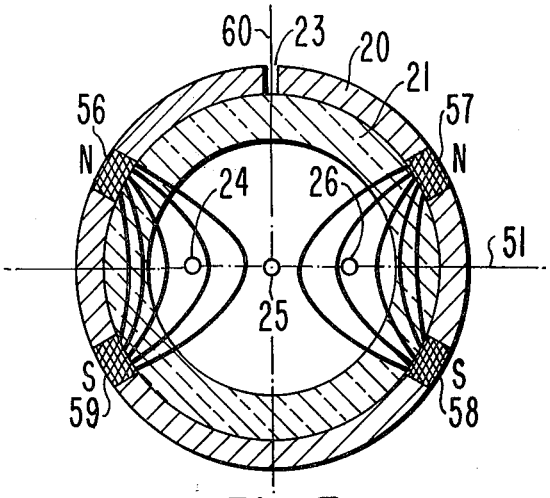

As shown in FIG. 6, magnetized regions, such as 54 and 55 which extend near the vertical center line 60, contribute to establishing a barrel field, while regions, such as 56–59 of FIG. 7 which extend closer to the in-line axis 51, contribute to establishing a pincushion field. The ends of elongated conductor loops 39 and 40 of FIG. 5 are located within approximately 5 degrees of the horizontal in-line axis 51 producing sufficiently extensive magnetized regions near the in-line axis for establishing the desired net pincushion shaped field. Alternatively or supplementarily, the pincushion shape of the field may be enhanced by diminishing or removing magnetized areas in strip 20 near the vertical center line 60, accomplished, for example, by decreasing the width of conductor loops 39–40 near the vertical center line.

Color purity correction for some cathode ray tubes may require up to ±5 mils of register correction as measured at the center of the screen in the horizontal direction. Magnetizing apparatus 28 must be capable of creating magnetized regions within strip 20 that are able to provide such magnitude motions. If a substantial component of the magnetic field within strip 20 is tangential to the periphery or circumference of neck 21, a sufficiently strong magnetic field can be created to provide these large magnitude beam motions.

Figure 8:
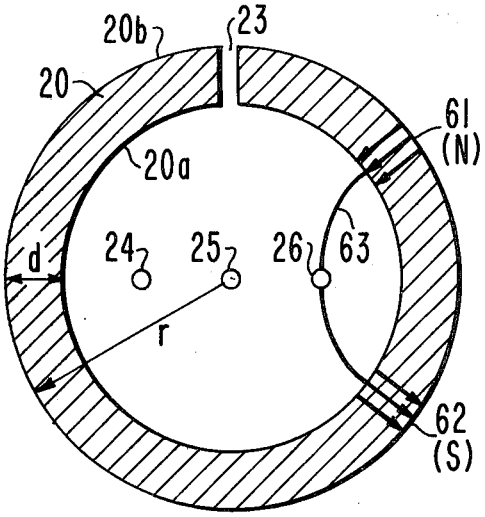
Figure 9:
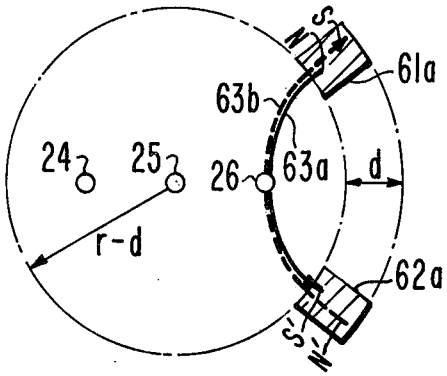

Consider magnetic regions 61 and 62 within strip 20, which contain no tangential field lines but only radial lines 63, as illustrated in FIG. 8. Such field lines may be produced, for example, by placing solenoid coils near regions 61 and 62 with appropriate polarity currents flowing through the coils. For a strip thickness d and outer radius r of FIG. 8, an equivalent bar magnet configuration is shown in FIG. 9. The separation of the poles N-S of bar magnet **61*a* and S′-N′ of bar magnet 62*a* is d. This separation is relatively small, typically 60 mils or less, when compared to the radius r, typically about 0.6 inch. Field line 63*a*, connecting the inner poles N & S′, will only be slightly greater in relative magnitude than field line 63*b*, connecting the outer poles S & N′. The net field, represented by field line 63, will be quite small unless the pole strengths of bar magnets 61*a* and 62*a*** are made relatively large.

Equivalently stated, the magnetizing current through the solenoid coils must be relatively great to produce a sufficient field intensity at the electron beam locations for providing any significant beam motion. It is even possible that a magnetizing apparatus using solenoidal coils may be incapable of producing the relatively intense fields required at the beam locations.

Furthermore, at certain locations along the central axis, field direction reversal may occur, resulting in beam motions opposite to the desired direction. Field direction reversal will occur if, at a given point on the central axis, the field lines connecting the S & N′ poles of magnets **61*a* and 62*a***, respectively, are more intense than the field lines connecting the other poles of the magnets. An even stronger overall field will be needed to provide the required net motion.

Figure 10:
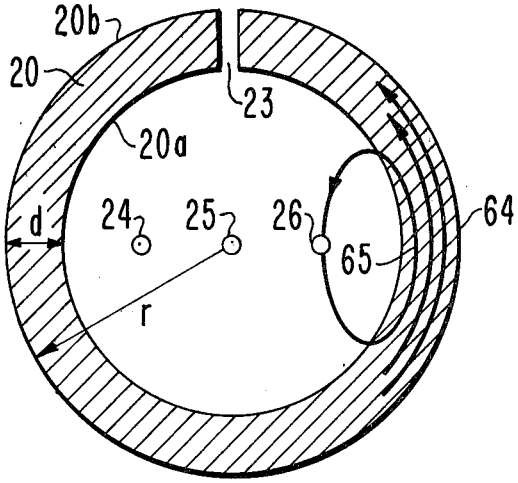
Figure 11:
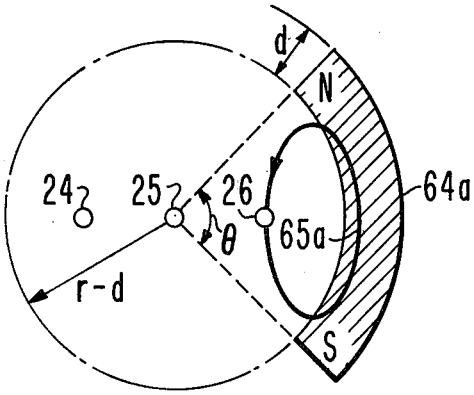

Consider, however, a strip 20 with a magnetized region 64 having only tangential field lines 65, as illustrated in FIG. 10. The equivalent bar magnet configuration comprising a portion of a C-shaped magnet **64*a* is illustrated in FIG. 11. The poles of magnet 64*a* are separated by a relatively large distance subtending an angle $\theta$. The net field 65a** is sufficiently intense to provide the required beam motions.

A relatively uncomplicated method of obtaining a magnetic field within strip 20 having a substantial tangential component is to so shape conductor loops 39 and 40 as to extend tangentially to the periphery of neck 21. As illustrated in FIG. 5, the magnetic field within strip 20 has substantial tangential components, such as component 52a of field line 52. Substantial motions for beams 24–26 can be provided without requiring relatively large magnetizing currents flowing through conductor loops 39 and 40.

Should more intense magnetic fields be desired, but without increasing the magnetizing current amplitude, added conductor loops may be positioned tangential to the neck periphery. These added loops need not extend angularly as close to the in-line axis of the first loops do. The amount of added pincushion shaped field, however, will be correspondingly less.

Typical characteristics for a magnetic strip 20, cathode ray tube 22 and magnetizing apparatus 28 are as follows:

Magnetic Strip: length 3.8", width 0.675", thickness 0.060", gap width 0.100" maximum; material—barium ferrite mixed in a rubber binder with a B-H characteristic of $1.1\times10^6$ gauss-oersteads minimum such as General Tire Compound 39900 from the General Tire & Rubber Company, Evansville, Indiana.

Cathode Ray Tube: 13 V in-line, 90° deflection, slot mask, 25 KV ultor, gun separation of 0.26", neck diameter 1.146".

Magnetizing Apparatus: four conductor loops, each loop of 0.040" square copper wire; width along central axis 225 mils, extension along the neck periphery 1.94" for an angular extension to within 5° of in-line axis; maximum beam motion required ±5 mils of register correction, peak magnetizing current needed for maximum register correction 2800 amps, magnetizing current pulse duration 15 μsec.

Static convergence correction may be performed by using conventional adjustable magnetic ring members, such as disclosed in U.S. Pat. No. 3,725,831 granted to R. L. Barbin. It may alternatively be performed by further creating appropriately magnetized regions in magnetic strip 20. A magnetizing unit capable of creating such regions is disclosed in copending U.S. Patent Application, entitled, MAGNETIZING APPARATUS & METHOD FOR PRODUCING A STATICALLY CONVERGED CATHODE RAY TUBE & PRODUCT THEREOF, Ser. No. 819,093, filed concurrently herewith, by Joseph Leland Smith. For certain cathode ray tubes, the magnetized regions for color purity correction should be those most forward of the electron guns thereby producing the least amount of beam defocussing.

What is claimed is:

1. A magnetizing apparatus for use in establishing the color purity of three in-line electron beams within a cathode ray tube of a color television receiver, said cathode ray tube including a magnetic material located adjacent to a neck portion, comprising:

at least two elongated conductor loops arranged for positioning about said neck portion in proximity to said magnetic material and capable of being energized by a magnetizing current for creating permanently magnetized regions within said magnetic material for producing a color purity magnetic field within said cathode ray tube for establishing the color purity of said three in-line electron beams, an elongated portion of each of said conductor loops following along a portion of the periphery of said neck portion.

2. A magnetizing apparatus according to claim 1, wherein said magnetizing apparatus creates magnetized regions near the in-line axis of said three in-line electron beams sufficiently extensive and of sufficient pole strength to produce a pincushion-shaped color purity magnetic field in a plane perpendicular to the central axis of said cathode ray tube adjacent to said magnetic material.

3. A magnetizing apparatus according to claim 2, wherein the ends of each of said conductor loops are located within approximately 5 degrees of said in-line axis.

4. A magnetizing apparatus for use in establishing the color purity of three in-line electron beams within a cathode ray tube of a color television receiver, said cathode ray tube including a magnetic material located adjacent to a neck portion, comprising:

at least two conductor loops arranged for positioning about said neck portion in proximity to said magnetic material and capable of being energized by a magnetizing current for creating permanently magnetized regions within said magnetic material for producing a color purity magnetic field within said cathode ray tube for establishing the color purity of said three in-line electron beams, said conductor loops shaped in a manner that will produce within said magnetic material upon energization by said magnetizing current a magnetic field that includes a substantial component that is tangential to a circumference of said neck portion.

5. A magnetizing apparatus according to claim 4, wherein said magnetizing apparatus creates magnetized regions angularly located near the in-line axis of said three in-line electron beams sufficiently extensive and of sufficient pole strength to produce a pincushion-shaped color purity magnetic field in a plane perpendicular to the central axis of said cathode ray tube adjacent said magnetic material.

6. A magnetizing apparatus according to claim 4, wherein each of said conductor loops is shaped to extend tangentially to a circumference of said neck portion.

7. A magnetizing apparatus according to claim 6, wherein the ends of said conductor loops is located within approximately 5 degrees of said in-line axis.

8. A cathode ray tube including a magnetic material located adjacent to a neck portion of said cathode ray tube with magnetized regions for establishing the color purity of three color electron beams within said cathode ray tube, said magnetic material including permanently magnetized regions fixedly located with polarities and pole strengths of the permanent regions selected to establish a color purity electron beam moving field, the permanent magnetic field within said magnetic material including a substantial component that is tangential to a circumference of said neck portion.

9. A cathode ray tube according to claim 8, wherein said magnetic field is of a pincushion shape in a plane perpendicular to the central axis of said cathode ray tube adjacent said magnetic material.

10. A cathode ray tube according to claim 9, wherein said magnetized regions extend adjacent to said in-line axis.

11. A cathode ray tube including a magnetic material located adjacent to a neck portion of said cathode ray tube with permanently magnetized regions fixedly located with polarities and pole strengths of the permanently magnetized regions establishing the color purity of three in-line electron beams within said cathode ray tube, said magnetic material including permanently magnetized regions that extend adjacent to the in-line axis of said electron beams.

12. A cathode ray tube including a magnetic material located adjacent a neck portion, said magnetic material including magnetized regions created by the magnetizing apparatus of claim 1.

13. A magnetizing apparatus for use in establishing the color purity of three in-line electron beams within a cathode ray tube of a color television receiver, said cathode ray tube including a magnetic material located adjacent to a neck portion, comprising:

an elongated conductor loop arrangement capable of being positioned about said neck portion in proximity to said magnetic material and capable of being energized by a magnetizing current for creating fixedly located permanently magnetized regions within said magnetic material for producing a color purity magnetic field within said cathode ray tube for establishing the color purity of said three in-line electron beams, said conductor loop arrangement shaped in a manner that will produce within said magnetic material upon energization by said magnetizing current a magnetic field that includes a substantial component that is tangential to a circumference of said neck portion.

14. A method of establishing the color purity of three in-line electron beams of a cathode ray tube comprising the steps of:

locating a magnetic material adjacent a neck portion of said cathode ray tube;

positioning about said neck portion at least two elongated conductor loops with an elongated portion of each of said conductor loops following along a portion of the periphery of said neck portion for creating permanently magnetized regions within said magnetic material upon the coupling of magnetizing current to said elongated conductor loops;

determining the amount of color purity correction required; and coupling magnetizing current of predetermined magnitudes and directions to said elongated conductor loops for establishing the color purity of said three in-line electron beams.

15. A method according to claim 14, wherein said elongated conductor loops are positioned about said neck portion in a manner creating magnetized regions near the in-line axis of said three in-line electron beams sufficiently extensive and of sufficient pole strength to produce a pincushioned-shaped color purity magnetic field in a plane perpendicular to the central axis of said cathode ray tube adjacent to said magnetic material.

* * * * *